US005870808A

United States Patent [19]

Bremser et al.

[11] Patent Number: 5,870,808

[45] Date of Patent: Feb. 16, 1999

[54] DRAW POINT CONTROL ARRANGEMENT

[75] Inventors: Kevin Guy Bremser, Ocean View; Nitin Jivanlal Champaneria; Jon Ovitt Stanley, both of Seaford, all of Del.

[73] Assignee: E. I. du Pont de Nemours and Company, Wilmington, Del.

[21] Appl. No.: 957,034

[22] Filed: Oct. 24, 1997

[51] Int. Cl.[6] ..... D02J 1/22

[52] U.S. Cl. ..... 28/241; 28/172.2

[58] Field of Search ..... 28/172.2, 240, 28/241, 242, 243, 244, 245, 246, 247; 57/287, 288; 264/40.1, 40.6, 40.7

[56] References Cited

U.S. PATENT DOCUMENTS

| | | | |
|---|---|---|---|
| 3,211,893 | 10/1965 | Barlow et al. | 28/241 |
| 3,660,550 | 5/1972 | Sempel | 28/241 |
| 5,110,517 | 5/1992 | Lukhard et al. | 264/40.1 |
| 5,664,307 | 9/1997 | Stitz et al. | 28/241 |

FOREIGN PATENT DOCUMENTS

| | | | |
|---|---|---|---|
| 2206577 | 8/1973 | Germany | 28/241 |

*Primary Examiner*—Michael A. Neas
*Assistant Examiner*—Larry D. Worrell, Jr.

[57] ABSTRACT

An apparatus and method for processing a synthetic yarn includes at least a one sensor for generating a signal representative of the actual velocity of the yarn at a point intermediate an upstream and the downstream rolls. The temperature of the upstream roll in accordance with the variation between the actual velocity of the yarn at the measurement point and a predetermined reference velocity. A second sensor may be provided to generate a signal representative of the actual velocity of the yarn at a second point intermediate the rolls. The controller may regulate the temperature of the upstream roll in accordance with the variation between the actual velocity at each measurement point and a predetermined reference velocity for that measurement point. Alternatively, the controller may regulate the temperature of the upstream roll in accordance with a relationship (e.g., the ratio) between the actual velocities as compared to a predetermined reference relationship (as, the ratio) representative of the relationship of the velocities of the upstream and downstream rolls, and the variation between the actual and reference velocities at at least one of the measurement points.

7 Claims, 6 Drawing Sheets

T
Y
A
H
U
S
A
26M
$T_A$
22A
P
32B
32A
Y
$T_B$
26M
22B
$V_B$ -REFERENCE
$V_A$ -REFERENCE
$V_A$ -ACTUAL
24A
28A
D
$V_B$ -ACTUAL
28
20
24B
Y
A $$V_{AVERAGE-REFERENCE} = \left\{ [\text{SPEED OF ROLL D} + \text{SPEED OF ROLL U}]/2 \right\}$$

DRAW POINT CONTROL ARRANGEMENT

BACKGROUND OF THE INVENTION

1. Field of the Invention

The present invention is directed toward an apparatus and method for controlling the draw point of a synthetic yarn.

2. Description of the Prior Art

Drawing is the process of stretching a partially oriented, or as-spun, yarn in order to develop the structure and properties required for commercial use. When compared to the undrawn yarn the desired properties include higher strength, lower elongation, higher modulus, and better recovery. Drawing is an irreversible elongation of the filaments of the yarn to as much as six times the original length for nylon, and even more for other yarns.

In the usual commercial environment drawing is usually accomplished in a continuous manner. Two rolls are required for continuous drawing, with the second (upstream) roll running at a faster speed than the first (downstream) roll. The "draw ratio" is the ratio between the surface speed of the second roll divided by the surface speed of the first roll.

The draw point is the location at which the necking, or narrowing, of the yarn occurs. Upstream of the draw point the undrawn yarn travels at a first velocity and exhibits a first predetermined cross-sectional area. However, the drawn yarn downstream of the draw point exhibits a second, narrower, cross-sectional area and travels at a commensurately higher velocity.

It is known that both operability of the yarn manufacturing processing and the uniformity of the drawn yarn can be improved by localizing the draw point. One common method of doing this is to locally heat the yarn to lower its yield point. This may be accomplished by heating one or more of the feed rolls that are upstream of the draw point. In addition, it is also a common practice to heat the downstream roll so that the drawn yarn may be bulked.

In the ideal case, it is desirable for all of the draw to occur in the clearance space between the two rolls. This condition is referred to as "space draw". Care must be exercised to insure that drawing of the yarn occurs away from the heated surface of either the upstream and/or the downstream roll. If drawing of the yarn is attempted on a heated surface, the possibility of yarn breakage is increased.

In view of the foregoing it is believed to be advantageous to provide an apparatus to control the location of the draw point so that the draw point is caused to occur in space intermediate the upstream and downstream rolls.

SUMMARY OF THE INVENTION

The present invention is directed to an apparatus for processing a synthetic yarn including at least a first, upstream, roll and a second, downstream, roll, and a heater for heating the first roll to a predetermined temperature. At least one sensor, such as a laser velocitometer, generates a signal representative of the actual velocity of the yarn at a point intermediate the upstream and the downstream rolls. A controller regulates the temperature of the upstream roll in accordance with the variation between the actual velocity of the yarn at the measurement point and a predetermined reference velocity. A second sensor may be provided to generate a signal representative of the actual velocity of the yarn at a second point intermediate the upstream and the downstream rolls. The controller may regulate the temperature of the upstream roll in accordance with the variation between the actual velocity at each measurement point and a predetermined reference velocity for that measurement point. Alternatively, the controller may regulate the temperature of the upstream roll in accordance with a relationship (e.g., the average or the ratio) between the actual velocities as compared to a predetermined reference relationship (as, a reference average or the draw ratio) representative of the relationship of the velocities of the upstream and downstream rolls. If a ratio is used as the relationship, the controller should also use the variation between the actual and reference velocities at at least one of the measurement points to regulate temperature.

A corresponding method in accordance with the present invention includes the steps of sensing the actual velocity of the yarn at a point intermediate the upstream and the downstream rolls and regulating the temperature of the upstream roll in accordance with the variation between the actual velocity of the yarn at the measurement point and a predetermined reference velocity. If the velocity at a second measurement point is taken the regulating step may be based on the the variation between the actual velocity and a reference velocity at each measurement point, or the relationship between the actual velocities.

The reference velocity(ies) may be defined as a predetermined range about (i.e., above and/or below) a predetermined velocity set point value. A variation (in either the positive or negative sense) occurs when an actual velocity is outside the boundaries of the range defining a given reference velocity.

BRIEF DESCRIPTION OF THE DRAWINGS

The invention will be more fully understood from the following detailed description thereof, taken in connection with the accompanying drawings, which form a part of this application, and in which:

FIGS. 2A and 2B are flow diagrams showing control schemes used in a draw point control apparatus in accordance with the present invention when the same is implemented using a single sensor, while

DETAILED DESCRIPTION OF THE FIGURES

Figure 1:
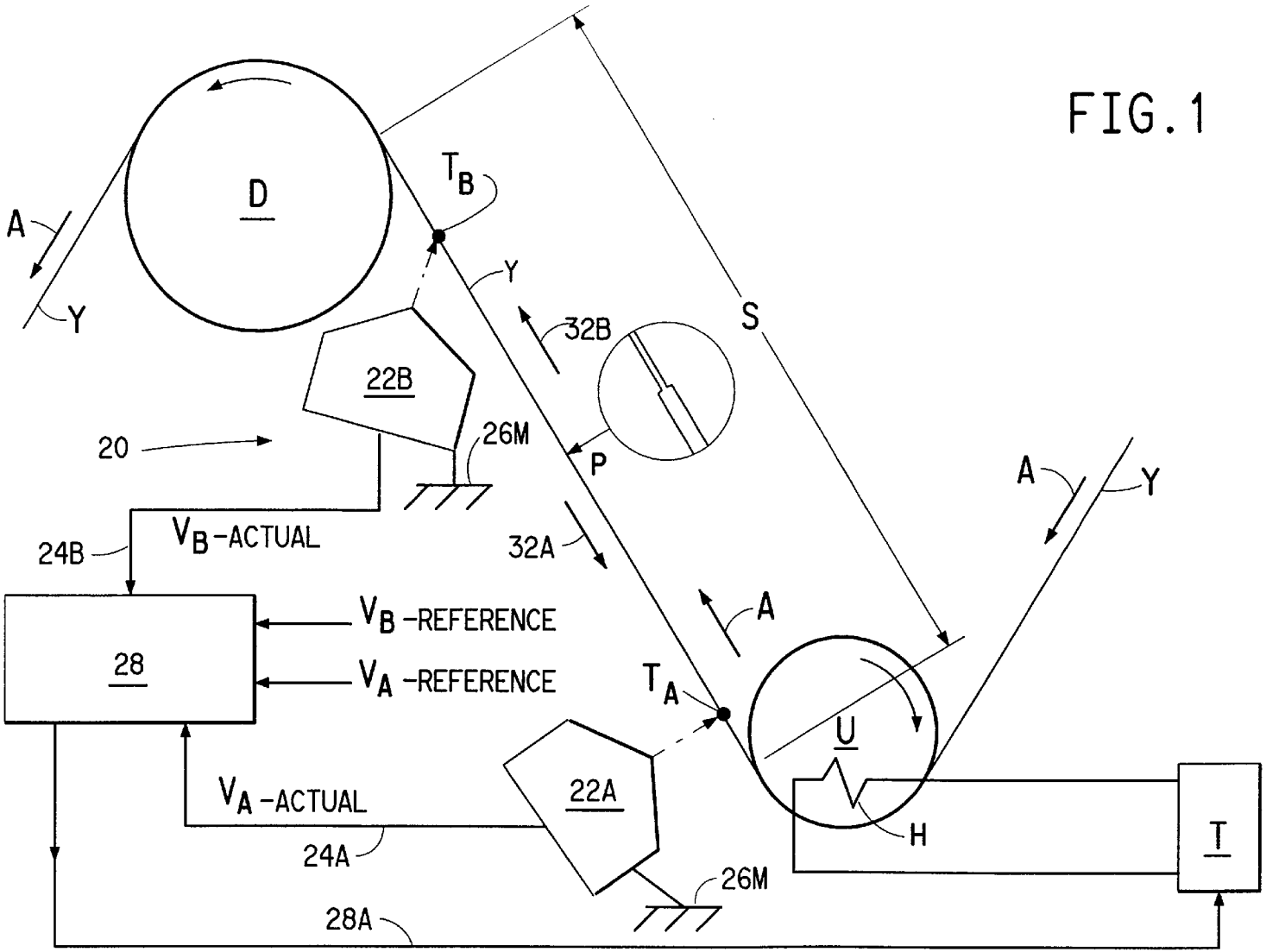
FIG. 1 is a stylized diagrammatic view of a portion of an apparatus for processing yarns with which a draw point control apparatus in accordance with the present invention finds utility.

Throughout the following detailed description similar reference numerals refer to similar elements in all Figures of the drawings.

Illustrated in FIG. 1 is a portion of an apparatus for processing a synthetic yarn Y moving through the apparatus along a processing path indicated by flow arrows A. The apparatus includes at least a first, upstream, roll U and a second, downstream, roll D. The rolls U, D are separated along the processing path A by a clearance space S. The clearance space S is defined along the processing path A between the point that the yarn Y leaves the upstream roll U and the point at which the yarn Y contacts the downstream roll D. As noted earlier, in processing yarn Y the ideal condition is to have all of the draw, or necking N of the yarn (as shown in the circled portion of FIG. 1) occur in the clearance space S. However, a more practically realizable goal is that at least some high percentage, on the order of ninety to ninety-eight percent of the draw, occur in the clearance space S.

To cause the yarn Y to draw at the desired location it is common practice that at least the upstream roll U is heated, as by a heater diagrammatically indicated by reference character H. The downstream roll D may also be (and in the typical operation, is) heated. The heater H may be implemented using any suitable heating arrangement, such as radiant heater or an induction heater. The temperature to which the roll U is raised is controlled using a closed loop temperature control arrangement T.

The present invention is directed toward a control arrangement 20 for maintaining the draw point P within the clearance space S. The control arrangement 20 includes at least one sensor 22A disposed to interrogate the space S. The sensor 22A is operative to generate a signal $V_{A\text{-}actual}$ on an output line 24A. The signal $V_{A\text{-}actual}$ is representative of the actual velocity of the yarn Y at the predetermined target point $T_A$ along the path of travel A of the yarn Y. In a more preferred case the control arrangement 20 also includes a second sensor 22B operative to generate a signal $V_{B\text{-}actual}$ on an output line 24B, where the signal $V_{B\text{-}actual}$ is representative of the actual velocity of the yarn Y at a second predetermined target point $T_B$ along the path of travel A of the yarn Y. The first sensor 22A, and the second sensor 22B, if utilized, is(are) mounted to a suitable mounting support shown diagrammatically by the reference character 26M so that the sensor(s) may interrogate the yarn Y in the manner indicated.

If only a single sensor 22A is used the predetermined target point $T_A$ is preferably located close to the upstream roll U (as is suggested in the illustration), although it could, in principle be located to interrogate any convenient point in the clearance space S. If the embodiment utilizing both sensors 22A, 22B is implemented, the target points $T_A$, $T_B$ should preferably be respectively located adjacent to both the upstream and downstream rolls U, D, although the sensors may be more closely spaced, if desired. Of course, the sensors 22A, 22B must be appropriately oriented on the mounting support 26M such that each sensor is positioned to interrogate its corresponding target point along the yarn path.

The sensor(s) 22A, 22B are preferably implemented using a laser velocitometer, such as the device sold by TSI Incorporated, Shore View, Minn., as model LS-50. This device includes suitable electronic circuitry to generate an actual velocity signal that is an average of some plurality of readings taken over some predetermined period of time. The laser velocitometer is preferred since physical contact with the yarn is not required to generate a velocity signal. It should be understood that alternative yarn speed monitoring devices, such as yarn speed wheel, may be used and remain within the contemplation of this invention.

The control arrangement 20 further includes a controller 28 responsive to the signal(s) 24A (and 24B, if the second sensor is implemented) for regulating the temperature of the upstream roll U in accordance with a control algorithm using the relationship between the actual velocity(ies) of the yarn Y at the measurement point(s) and predetermined reference velocity(ies) or between the relationship between of the actual velocity(ies) of the yarn Y at the measurement point (s). The controller 28 may be implemented in any convenient fashion, as by a distributed process control system (DCS) available from Honeywell Incorporated, Phoenix, Ariz., as the TDC-3000, operating in accordance with a suitable control program able to implement the algorithms set forth herein. Appropriate conditioning and scaling of the signals may be required, as would be apparent to those skilled in the art.

The output of the controller 28 is applied over a line 28A to the temperature control arrangement T, thereby to adjust the temperature of the upstream roll U. Appropriate adjustment of the temperature of the upstream roll U results in the relocation of the draw point P of the yarn Y. Generally speaking, if examination of the velocity of the yarn Y indicates that the draw point P is further downstream than desired (i.e., the draw point P is closer to the downstream roll D than desired), then the temperature of the upstream roll U is raised. Raising the temperature of the upstream roll U has the effect of reducing the tension in the yarn, making the resistance of the yarn to draw forces weaker, and causing the yarn to draw at a point further upstream.

Single Sensor

Figure 2A:
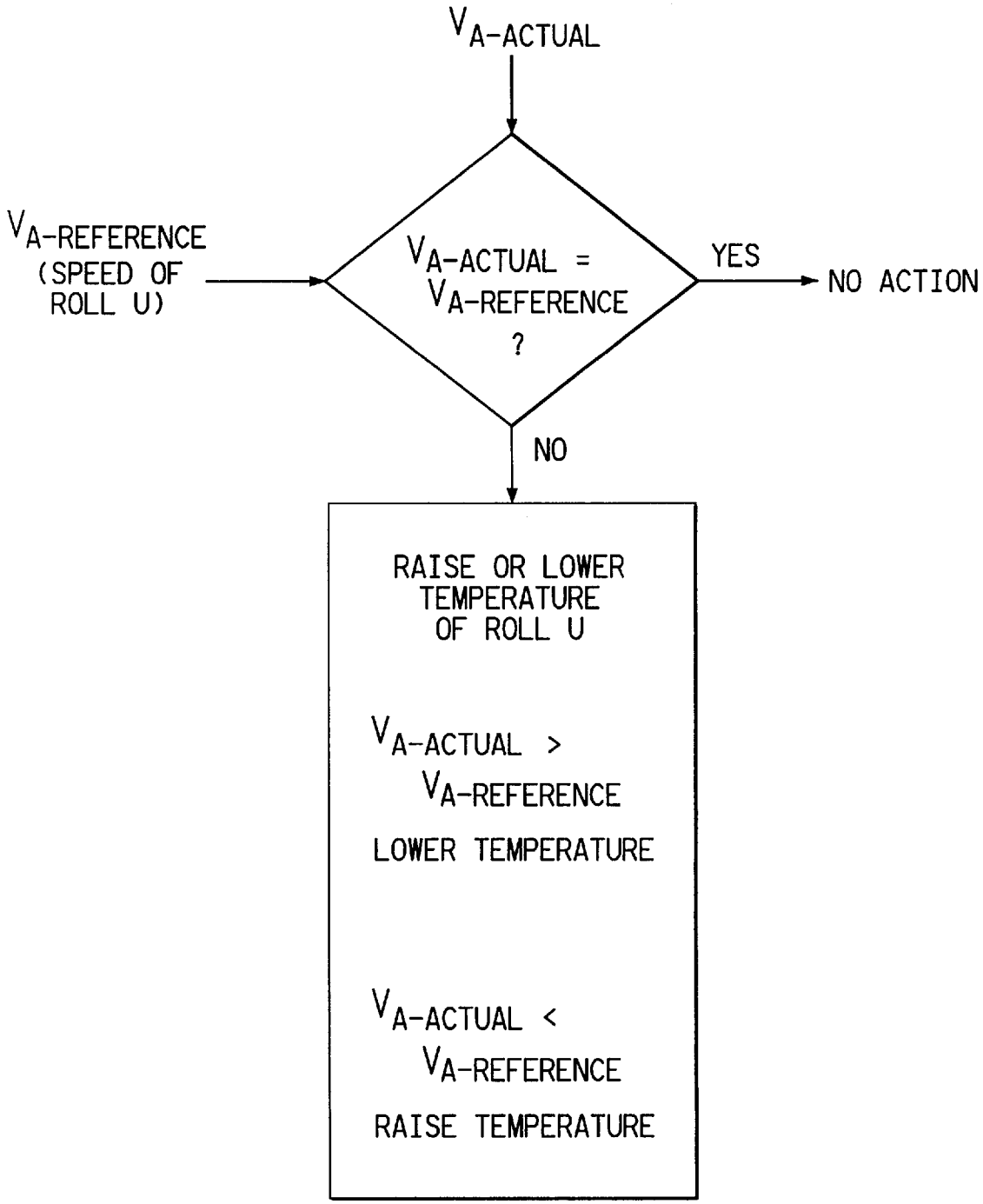

FIG. 2A is a flow diagram of a control algorithm implemented by the controller 28 when a single sensor 22A is used. The heart of the algorithm is a comparison of the actual velocity $V_{A\text{-}actual}$, as sensed by the sensor 22A, to a predetermined reference velocity $V_{A\text{-}reference}$, where $V_{A\text{-}reference}$ represents the velocity that a drawn yarn would exhibit at the target point $T_A$. Assuming, for example, that the target point $T_A$, and thus the sensor 22A, are located proximal to the upstream roll U. The reference velocity $V_{A\text{-}reference}$ in such a case is based upon the speed of the upstream roll U. In such a situation the result of the comparison showing that the actual velocity $V_{A\text{-}actual}$ varies (in this instance, by being less than) the reference velocity $V_{A\text{-}reference}$ indicates that the draw point of the yarn is occurring at a point along the yarn path P that is downstream of the target point $T_A$. Corrective action in such an instance is a signal to the temperature controller T increasing the temperature of the upstream roll U, thereby moving the draw point P in an upstream direction (in the direction of arrow 32A).

Conversely, if the comparison indicates that the actual velocity varies by being greater than the reference velocity $V_{A\text{-}reference}$, then the draw point P of the yarn Y is occurring at a point along the yarn path A at or upstream of the target point $T_A$. Corrective action in this instance is a signal to the temperature controller T lowering the temperature of the upstream roll U (i.e., cooling the roll), thereby moving the draw point P in a downstream direction (in the direction of arrow 32B).

If the actual velocity does not vary from the reference velocity $V_{A\text{-}reference}$, then no corrective action is required in such an instance.

In practice, the reference velocity, as that term is used in this application, is defined as a predetermined velocity range about a predetermined velocity set point. Defining the reference velocity as a range, (a "dead-band" or "window"), about a predetermined reference velocity set point recognizes the practical reality that each of the filaments constituting a yarn does not draw at exactly the same location in space. The predetermined velocity set point is selected in any convenient fashion, such as, in accordance with the desired surface speed of the roll proximal to the sensor (in the case of the example above, the upstream roll U). The magnitude of the range above and below the predetermined velocity set point is conveniently selected as some predetermined percentage (e.g., ten percent in the first example) above and below the predetermined velocity set point.

A variation (in either the positive or negative sense) from the reference velocity occurs when the value of an actual velocity signal is outside the boundaries of the range.

Figure 2B:
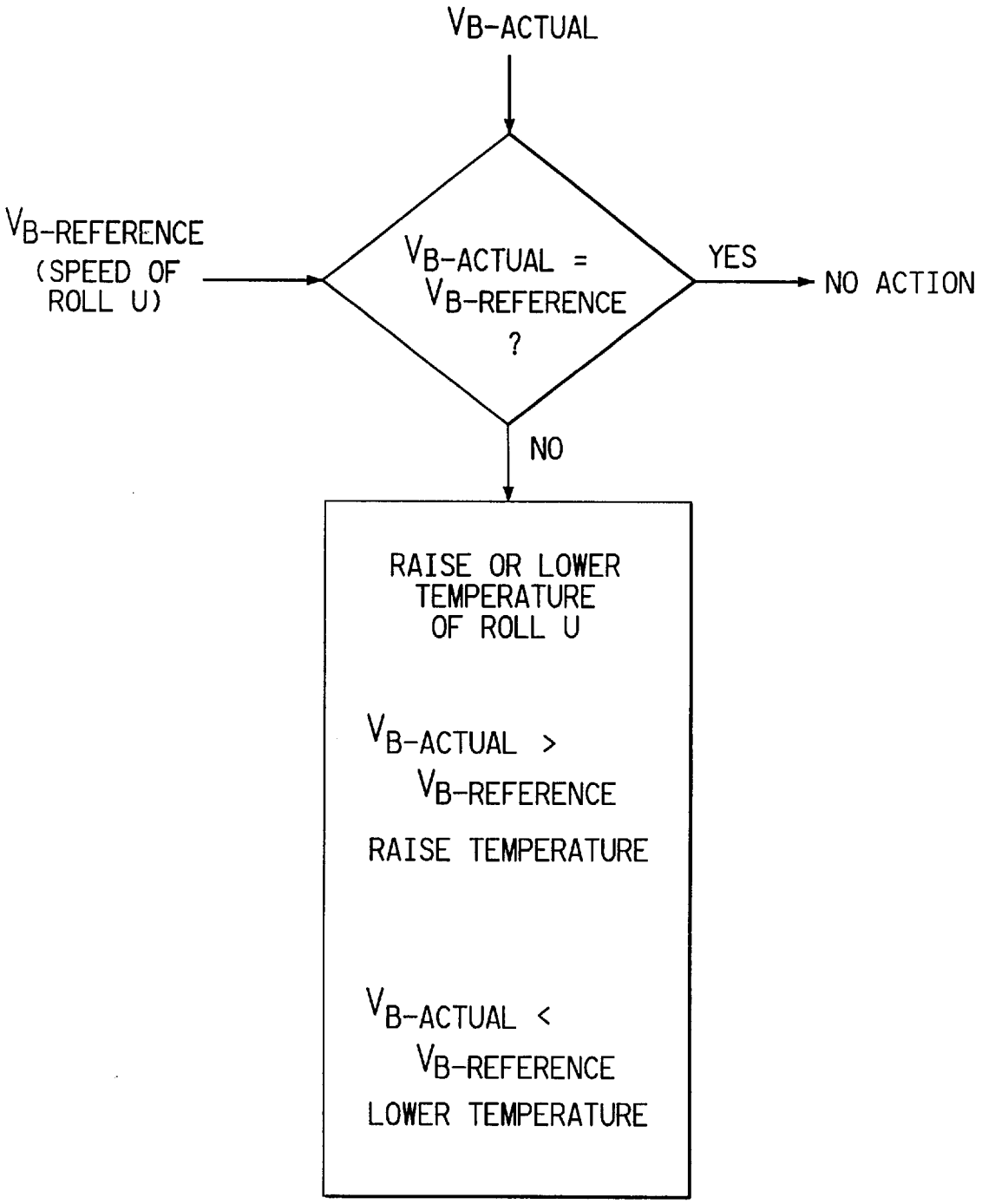

As another example of a single sensor arrangement, assume that only the sensor 22B is positioned adjacent to the downstream roll D. In such an instance the velocity of the downstream roll D is used as the set point to generate the range that defines the predetermined reference velocity $V_{B\text{-}reference}$. For example the range may extend to about eighty-five percent of this velocity set point. The flow diagram of a suitable control algorithm in this instance is shown in FIG. 2B. In this situation if the result of the comparison shows that the actual velocity $V_{B\text{-}actual\ varies\ from\ (e.g.,\ by\ being\ less\ than)\ the\ reference\ velocity\ V_{B\text{-}reference}}$, corrective action is a signal to the temperature controller T decreasing the temperature of the upstream roll U. Conversely, if the comparison indicates that the actual velocity varies by being greater than the reference velocity $V_{B\text{-}reference}$, corrective action would be to increase the temperature of the upstream roll U.

Dual Sensor

Figure 2C:
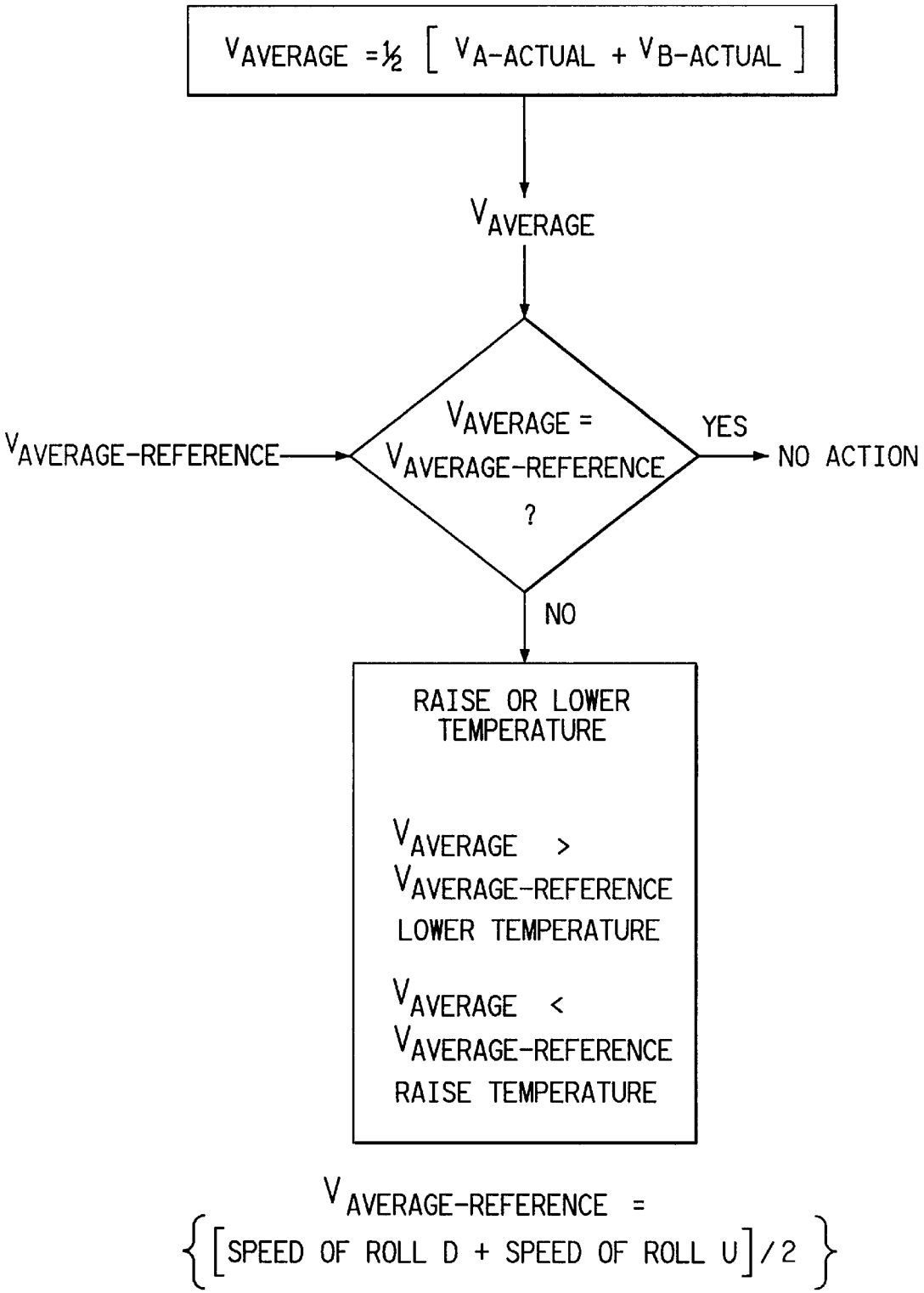
FIGS. 2C, 2D and 2E show flow diagrams illustrating control schemes which may be used when the draw point control apparatus is implemented using dual sensors.
Figure 2D:
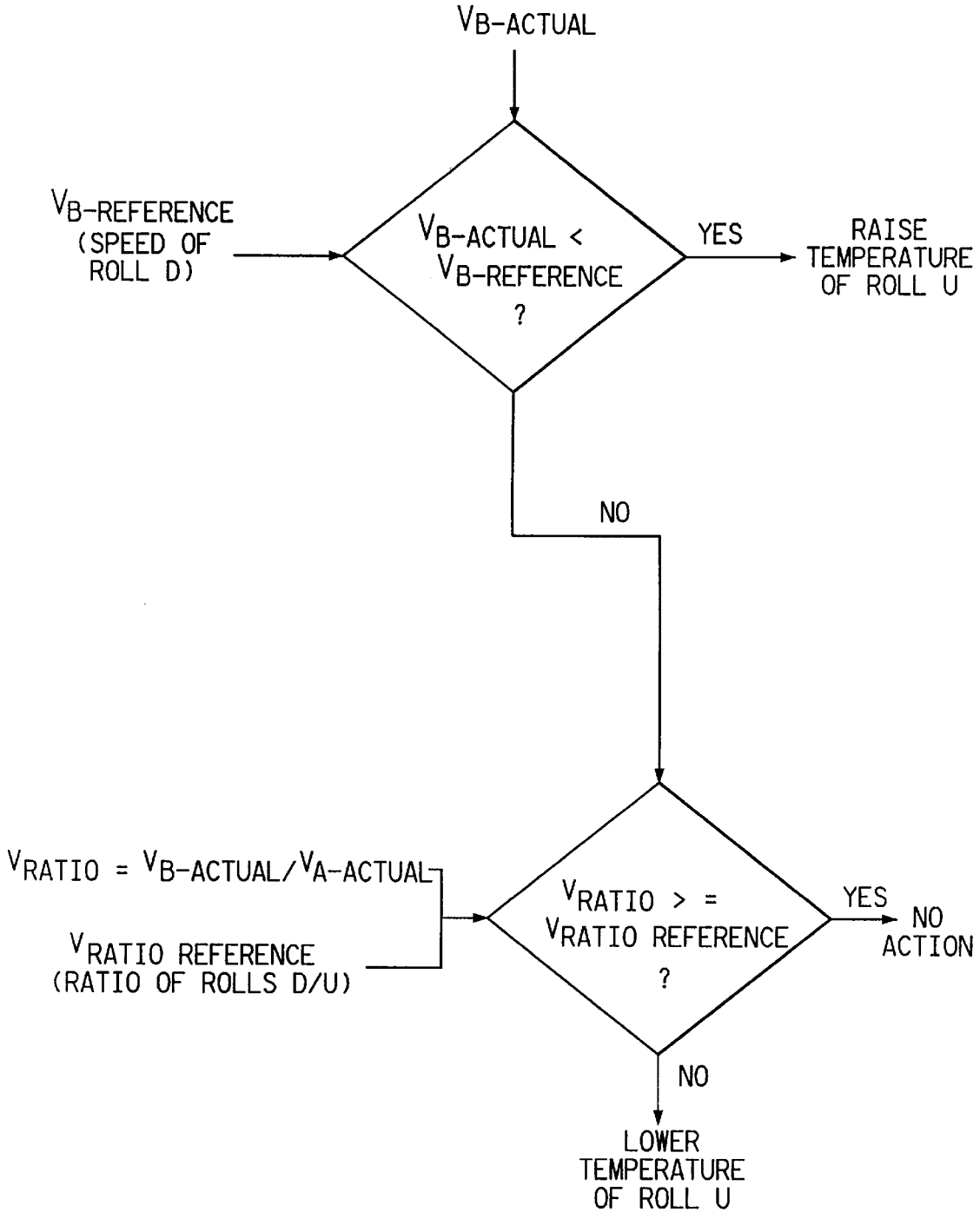
Figure 2E:
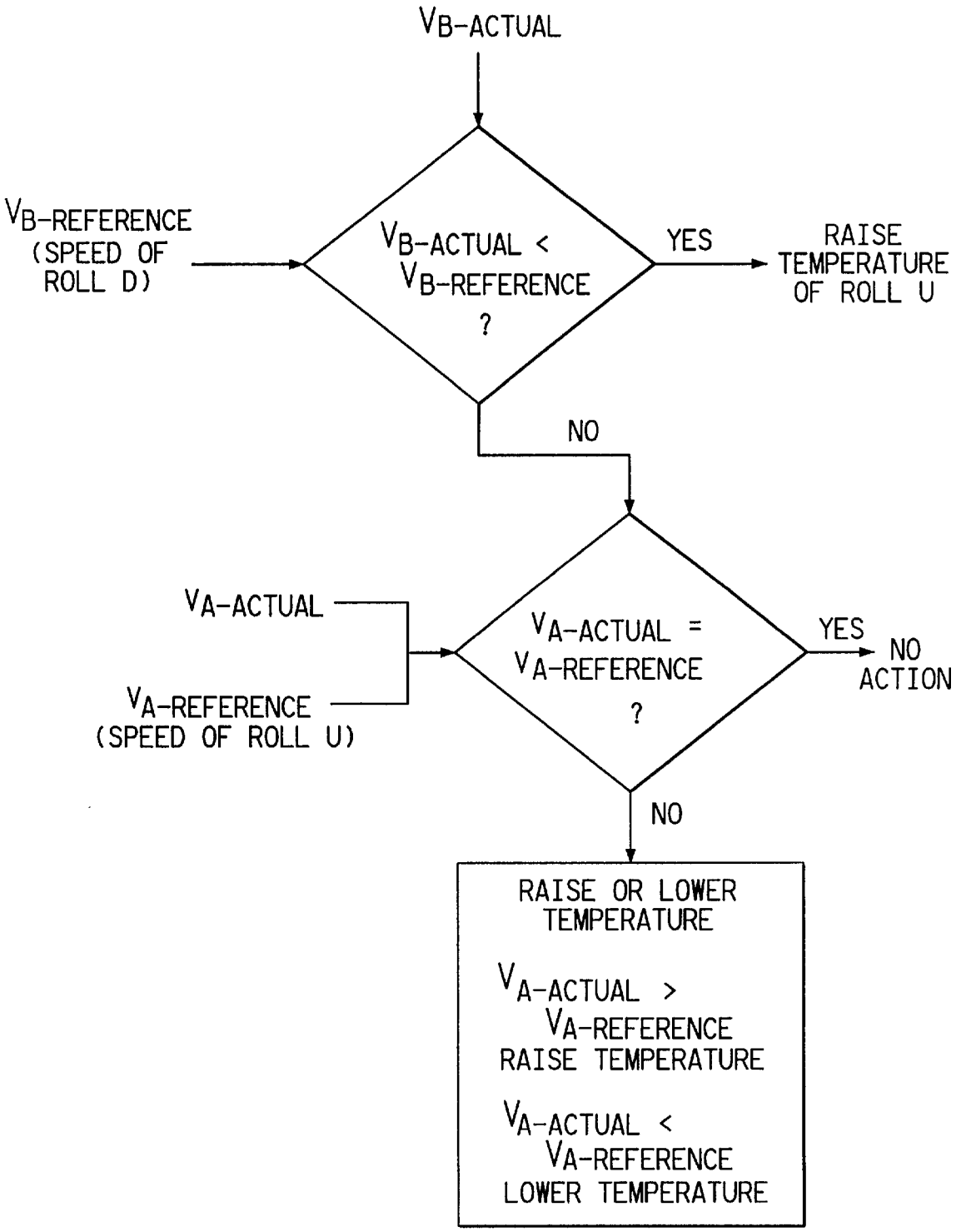

FIGS. 2C through 2E are flow diagrams of control algorithms that may be implemented by the controller 28 when a pair of sensors 22A, 22B are used. The sensors 22A, 22B are positioned along the mounting supports 26M to interrogate the speed of the yarn Y at respective target points $T_A$ and $T_B$ in the clearance space S.

The algorithm shown in FIG. 2C utilizes the comparison of a predetermined relationship between the actual velocity $V_{A\text{-}actual}$ and the actual velocity $V_{B\text{-}actual}$ and a corresponding relational reference. As seen in FIG. 2C the relationship relied upon is the average velocity $V_{Average}$ of the actual velocity $V_{A\text{-}actual}$ and the actual velocity $V_{B\text{-}actual}$. The relational reference $V_{Average\text{-}reference}$ utilized in this implementation is the average of the set point velocities of the rolls U, D. In this case, the range (e.g., ten percent) only extends above the set point average.

If the comparison shows that the actual velocity average $V_{Average}$ varies above the corresponding reference $V_{Average\text{-}reference}$, then appropriate corrective action is to lower the temperature of the upstream roll U. Conversely, it the velocity average $V_{Average}$ varies below the reference, the temperature of the roll U is raised. Of course, no action is taken if the velocity average $V_{Average}$ equals (i. e., is within the band about) the reference.

It should be appreciated that various alternative implementations in the dual sensor case may be used. For example, the ratio of the actual velocity $V_{A\text{-}actual}$ to the actual velocity $V_{B\text{-}actual}$ may be utilized as the generated relationship and compared to a corresponding relational reference. In such a case, a useful relational reference would be the yarn draw ratio. It will be recalled that the draw ratio is itself defined as the ratio of the surface speed of the downstream roll to that of the upstream roll. When the draw ratio is used a comparison between at least one actual velocity and the corresponding velocity reference is required before appropriate corrective action is effected. Typical ranges about the set point for both references may lie five percent (5%) below the appropriate set point. Thus, $V_{A\text{-}reference}$ is five percent (5%) below the set point speed of roll D while the reference $V_{ratio\ reference}$ is five percent (5%) below the ratio sep point. Appropriate corrective actions in this example are shown in FIG. 2D.

As an additional alternative, a straight forward comparison of each of the actual velocities $V_{A\text{-}actual}$ and $V_{B\text{-}actual}$ to a respective corresponding reference velocity $V_{A\text{-}reference}$ and $V_{B\text{-}reference}$ may also be made. In the two-sensor environment the reference velocity $V_{A\text{-}reference}$ represents that velocity that an undrawn yarn would exhibit at the target point target point $T_A$, while the reference velocity $V_{B\text{-}reference}$ represents that velocity that a drawn would exhibit at the target point $T_B$. Again, the value of the reference velocity $V_{A\text{-}reference}$ and $V_{B\text{-}reference}$ may be defined as some predetermined range about the velocity set point values that an appropriately undrawn or drawn yarn would exhibit at the respective target point target point $T_A$, $T_B$. These set points are thus based on the speeds of the rolls U, D, respectively. A useful set point value for each target point would be the velocity of the roll to which the sensor is proximal. A typical range about the set point for the reference $V_{B\text{-}reference}$ may lie five percent (5%) below the appropriate set point (the speed of the roll D) while a typical range about the set point for the reference $V_{A\text{-}reference}$ may lie ten percent (10%) above the appropriate set point (the speed of the roll U). Appropriate corrective actions in this example are shown in FIG. 2E.

The arrangement herein described may be used with advantage in the processing of a warp array or yarns Y, in which a plurality of yarns move in a parallel array through the processing apparatus.

Those skilled in the art, having the benefit of the teachings of the present invention as hereinabove set forth, may effect numerous modifications thereto. Such modifications are to be construed as lying within the contemplation of the present invention, as defined by the appended claims.

What is claimed is:

1. In an apparatus for processing a synthetic yarn including:

at least a first, upstream, roll and a second, downstream, roll, and a heater for heating the first roll to a predetermined temperature, the improvement comprising:

a sensor for generating a signal representative of the actual velocity of the yarn at a measurement point intermediate the upstream and the downstream rolls; and a controller for regulating the temperature of the upstream roll in accordance with the variation between the actual velocity of the yarn at the measurement point and a predetermined reference velocity.

2. The apparatus for processing a synthetic yarn in accordance with claim 1, wherein:

the velocity sensor comprises a laser velocitometer.

3. In an method for processing a synthetic yarn including the steps of:

conveying the yarn over at least a first, upstream, roll and a second, downstream, roll, and heating the first roll to a predetermined temperature, the improvement comprising the steps of:

sensing the actual velocity of the yarn at a measurement point intermediate the upstream and the downstream rolls; and regulating the temperature of the upstream roll in accordance with the variation between the actual velocity of the yarn at the measurement point and a predetermined reference velocity.

4. In an apparatus for processing a synthetic yarn including:

at least a first, upstream, roll and a second, downstream, roll, and a heater for heating the first roll to a predetermined temperature, the improvement comprising:

a sensor for generating a signal representative of the actual velocity of the yarn at a first and a second measurement point intermediate the upstream and the downstream rolls; and a controller for regulating the temperature of the upstream roll in accordance with:

the average of the actual velocity of the yarn at each measurement point and a predetermined reference average.

5. In an apparatus for processing a synthetic yarn including:

at least a first, upstream, roll and a second, downstream, roll, and a heater for heating the first roll to a predetermined temperature, the improvement comprising:

a sensor for generating a signal representative of the actual velocity of the yarn at a first and a second measurement point intermediate the upstream and the downstream rolls; and a controller for regulating the temperature of the upstream roll in accordance with the variation between the actual velocity of the yarn and a predetermined reference velocity at each measurement point.

6. The apparatus for processing a synthetic yarn in accordance with claim 5, wherein:

the velocity sensor comprises a first and a second laser velocitometer, the first velocitometer being disposed proximal to the first measurement point and the second velocitometer being disposed proximal to the second measurement point.

7. In an apparatus for processing a synthetic yarn including:

at least a first, upstream, roll and a second, downstream, roll, and a heater for heating the first roll to a predetermined temperature, the improvement comprising:

a sensor for generating a signal representative of the actual velocity of the yarn at a first and a second measurement point intermediate the upstream and the downstream rolls; and a controller for regulating the temperature of the upstream roll in accordance with:

(1) the ratio relationship between the actual velocity of the yarn at each measurement point and a predetermined reference ratio representative of the relationship of the velocities of the upstream and downstream rolls, and (2) the variation between the actual velocity of the yarn and a predetermined reference velocity at at least one measurement point.

* * * * *